US006155561A

United States Patent [19]

Mandel

[11] Patent Number: 6,155,561

[45] Date of Patent: Dec. 5, 2000

[54] SHEET VARIABLE SIDE SHIFT INTERFACE TRANSPORT SYSTEM WITH VARIABLY SKEWED ARCUATE BAFFLES

[75] Inventor: Barry P. Mandel, Fairport, N.Y.

[73] Assignee: Xerox Corporation, Stamford, Conn.

[21] Appl. No.: 09/179,366

[22] Filed: Oct. 26, 1998

[51] Int. Cl.[7] ..... B65H 9/04

[52] U.S. Cl. ..... 271/254; 271/227; 271/241; 271/184; 271/225

[58] Field of Search ..... 271/227, 241, 271/254, 184, 225

[56] References Cited

U.S. PATENT DOCUMENTS

| | | | |
|---|---|---|---|
| 3,548,783 | 12/1970 | Knapp | 118/224 |
| 4,805,892 | 2/1989 | Calhoun | 271/225 |
| 4,994,864 | 2/1991 | Schieck et al. | 355/317 |
| 5,439,208 | 8/1995 | Moser et al. | 271/225 |
| 5,467,179 | 11/1995 | Boeck et al. | 355/309 |
| 5,794,176 | 8/1998 | Milillo | 702/150 |

FOREIGN PATENT DOCUMENTS

| | | | |
|---|---|---|---|
| 59-203029 | 11/1984 | Japan | 271/225 |
| 6-263289 | 9/1994 | Japan | 271/225 |

*Primary Examiner*—Donald P. Walsh
*Assistant Examiner*—David A Jones

[57] ABSTRACT

In a lateral sheet shifting system, wherein sheets are fed from a sheet input to a sheet output with controlled shifting transversely of the process direction, there is a pivotal arcuate sheet path defining baffle unit providing an arcuate sheet-feeding path between the input and output. This arcuate baffle unit is mounted for pivotal angular movement laterally of the process direction by a controllable automatic variable angle pivoting system to form a variable sheet spiraling path therein. The arcuate baffle unit may be generally "S" or "U" shaped, and may be defined by, or consist solely of, opposing relatively closely spaced similarly arcuate baffles, such as at least two operatively connecting but oppositely facing generally quarter-cylindrical sections which can provide sheet side shifting without introducing any sheet skewing. The sheets in the baffle unit need not be engaged by any sheet feeding rollers therein, and the sheet input and output can be simple conventional fixed rollers on fixed axes. The sheet input and output may be co-linear but at different vertical levels. This entire sheet side shifting system can be a small, short paper path, modular unit provided internally or externally of a reproduction apparatus, such as interconnecting to a finisher with a laterally different paper path.

8 Claims, 3 Drawing Sheets

SHEET VARIABLE SIDE SHIFT INTERFACE TRANSPORT SYSTEM WITH VARIABLY SKEWED ARCUATE BAFFLES

Disclosed in the embodiments herein is an improved system for controlling, correcting or changing the lateral position of sheets traveling in a sheet transport path, in particular, sheets being printed in a reproduction apparatus, which may include sheets being fed to be printed, sheets being recirculated for second side (duplex) printing, and/or sheets being outputted to a stacker, finisher or other output or module.

Various types of variable or active, as opposed to passive, sheet side shifting or lateral registration systems are known in the art. It is particularly desirable to be able do so "on the fly", while the sheet is moving through or out of the reproduction system at normal process (sheet transport) speed. Also, to be able to do so with a system that does not substantially increase the existing sheet path length, or increase paper jam tendencies. The following patent disclosures, and other patents cited therein are noted by way of some examples of active sheet lateral registration systems with various means for side-shifting or laterally repositioning the sheet: Xerox Corporation U.S. Pat. No. 5,794,176 issued Aug. 11, 1998 to W. Milillo; U.S. Pat. No. 4,971,304 issued Nov. 20, 1990 to Lofthus; U.S. Pat. No. 5,156,391 issued Oct. 20, 1992 to G. Roller; U.S. Pat. No. 5,078,384 issued Jan. 7, 1992 to S. Moore; U.S. Pat. No. 5,094,442 issued Mar. 10, 1992 to D. Kamprath, et al; U.S. Pat. No. 5,219,159 issued Jun. 15, 1993 to M. Malachowski et al; U.S. Pat. No. 5,169,140 issued Dec. 8, 1992 to S. Wenthe; and U.S. Pat. No. 5,697,608 issued Dec. 16, 1997 to V. Castelli, et al. Also, IBM U.S. Pat. No. 4,511,242 issued Apr. 16, 1985 to Ashbee, et al.

The lateral repositioning system disclosed in the embodiments herein provides a simple system for transversely repositioning sheets into desired lateral position with a simple, low cost, mechanism, which needs only one simple control or drive system, in contrast to various of the above cited systems which require two or three separate, and separately controlled, servo or stepper motor drives for the sheet, or solenoid opening nips and scuffer wheels, as well as various sensors. Yet this present system can provide active, variable, side shifting or lateral registration, while the sheet is moving through, or out of, a reproduction system, without stopping. Furthermore, this lateral registration can be accomplished in a sheet path segment which does not substantially increase the sheet jam tendencies or the existing sheet path length. The sheet may be carefully confined at all times within path controlling sheet path baffles, and positively engaged and driven by otherwise normal sheet feeding sheet path driven rollers. No scuffing or twisting of the paper relative to any of the engaging sheet feed rollers, or vice versa, is required here. Nor is there any sheet edge wear or edge damage problem with the present system, since the sheet edges need not contact or be engaged by edge guides in order to provide edge registration. Nor do any sheet feeding nips have to be opened and closed for each fed sheet to allow for lateral registration. Thus, a significant advantage of this system is that each sheet can be under the positive feeding nip control of both the entrance and exit sheet transport nips of the subject arcute baffle system at the same time, even though substantial side shifting is taking place.

Furthermore, the sheet paths for the disclosed sheet lateral repositioning system provide large diameter curved, smoothly arcuate, sheet paths, such as a large "S", which (as is well known in the art) not only have reduced sheet jam tendencies as compared to small, sharp, paper path bends, but can actually enhance sheet beam strength and thus sheet control transversely of the sheet path. Furthermore, in the present system, the sheet lateral movement is accomplished gradually as it goes through the path system.

A specific feature of the specific embodiments disclosed herein is to provide in a lateral sheet shifting system for the image substrate sheets of a reproduction apparatus, with a sheet input and a sheet output, wherein said sheets are being fed in a process direction in a sheet feeding path from said sheet input to said sheet output with controlled shifting of said sheets transversely of said process direction, the improvement comprising: an arcuate sheet path defining baffle unit operatively interconnecting between said sheet input and said sheet output to define an arcuate sheet feeding path therein through said arcuate sheet path defining baffle unit; said arcuate sheet path defining baffle unit being mounted for pivotal movement angularly of said process direction; and a controllable variable angle pivoting system for pivoting said arcuate sheet path defining baffle unit angularly of said process direction; said sheets being laterally shifted transversely of said process direction within said arcuate sheet path defining baffle unit in proportion to said controllable variable angle pivoting of said arcuate sheet path defining baffle unit by said controllable variable angle pivoting system.

Further specific features disclosed herein, individually or in combination, include those wherein said arcuate sheet path defining baffle unit is generally "S" shaped, and/or wherein said arcuate sheet path defining baffle unit comprises opposing relatively closely spaced similarly arcuate baffles, and/or wherein said arcuate sheet path defining baffle unit consists solely of opposing arcuate baffles, and said sheets therein are not engaged by any sheet feeding rollers, and/or wherein said arcuate sheet path defining baffle unit is generally "U" shaped, and/or wherein said arcuate sheet path defining baffle unit comprises at least two operatively connecting but oppositely facing generally quarter-cylindrical baffle portions forming a general "S" shaped paper path therethrough, and/or wherein said arcuate sheet path defining baffle unit consists solely of opposing relatively closely space arcuate baffles, and wherein said sheets therein are not engaged by any sheet feeding rollers, and/or wherein said arcuate sheet path defining baffle unit is pivoted at an angle laterally of said process direction to form a spiral sheet path therein, and/or wherein said arcuate sheet path defining baffle unit is pivoted at an angle laterally of said process direction and induces lateral side shifting without any skew in said sheets passing therethrough, and/or wherein said sheet input and said sheet output comprise fixed sheet feed rollers with a fixed axis of rotation perpendicular to said process direction, and/or wherein said sheet input and said sheet output are co-linear but at different, first and second, vertical levels, and said arcuate sheet path defining baffle unit has a sheet entrance at said first level from said sheet input and a sheet exit at said second level to said sheet output, and/or wherein said sheet input and said sheet output comprise fixed sheet feed rollers with a fixed axis of rotation perpendicular to said process direction.

Further by way of background, it is known to provide for the inversion, and change in direction, of a moving web or sheet for a copier or printer by wrapping the web by 180 degrees around one or more hemi-cylindrical paper path baffles angled at 45 degrees to the entering sheet path. Particularly noted are the various embodiments of Xerox Corporation U.S. Pat. No. 3,548,783 issued Dec. 22, 1970 to Lowell W. Knapp. Also noted is U.S. Pat. No. 5,467,179.

As to further general background in sheet handling, in reproduction apparatus, such as xerographic and other copiers and printers or multifunction machines, it is increasingly important to provide faster yet more reliable and more automatic handling of the physical image bearing sheets. It is desirable to reliably feed and accurately register document and/or copy sheets of a variety and/or mixture of sizes, types, weights, materials, humidity and other conditions. The sheets which may be handled in or outputted from reproduction apparatus may even have various irregularities. Sheets can vary considerably even if they are all of the same "standard" size (e.g., letter size, legal size, A-4, B-4, etc.). They may have come from different paper batches or have variably changed size with different conditions, different imaging, fusing of an image on one or both sides, etc. Avoidance of sheet skewing or other misregistration is also important for proper imaging. Otherwise, borders and/or edge shadow images may appear on the copy sheet; and/or information near an edge of the image may be lost. Sheet misregistration or misfeeding can also adversely affect further feeding, ejection, and/or stacking and finishing.

In some reproduction situations, it may be desired to deliberately provide a substantial, but controlled, sheet side shift, varying with the sheet's lateral dimension, such as in feeding sheets from a reproduction apparatus with a side registration system into a connecting finisher having a center registration system. Or, in duplex printing, for providing appropriate or desired side edge margins on the inverted sheets being recirculated for their second side printing after their first side printing.

As is taught by the above-cited and many other references, the disclosed system may be operated and controlled as described by appropriate operation of conventional control systems. It is well known and preferable to program and execute printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or VLSI designs.

It is well known in the art that the control of sheet handling systems may be accomplished by conventionally actuating them with signals from a microprocessor controller directly or indirectly in response to programmed commands and/or from selected actuation or non-actuation of conventional switch inputs or sensors. The resultant controller signals may conventionally actuate various conventional electrical solenoids, servo or stepper motors, clutches, or other components, in programmed steps or sequences.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of some specific embodiments, including the drawing figures (approximately to scale) wherein:

Figure 2:
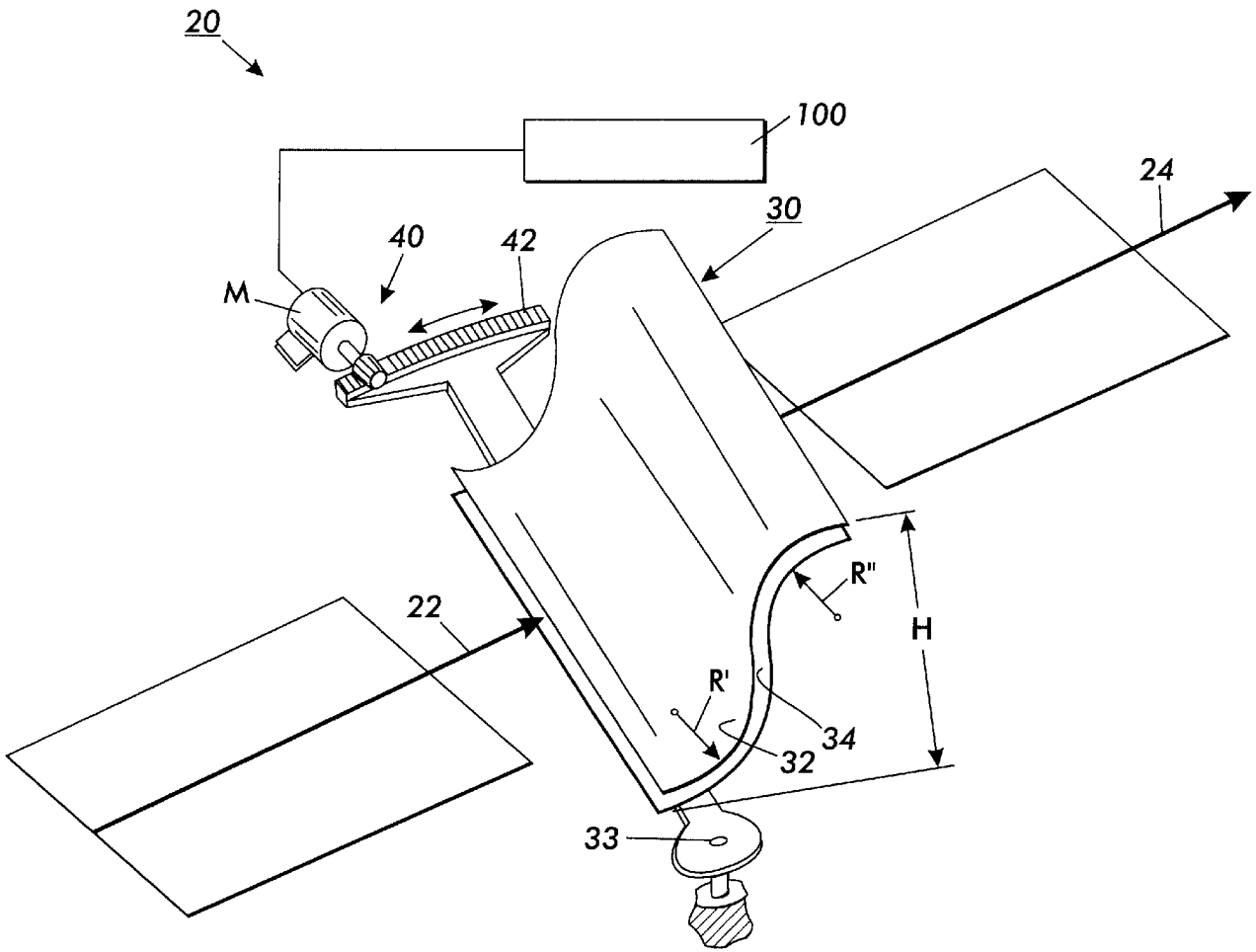
FIG. 2 is a further simplified schematic perspective view of the embodiment of FIG. 1.
Figure 3:
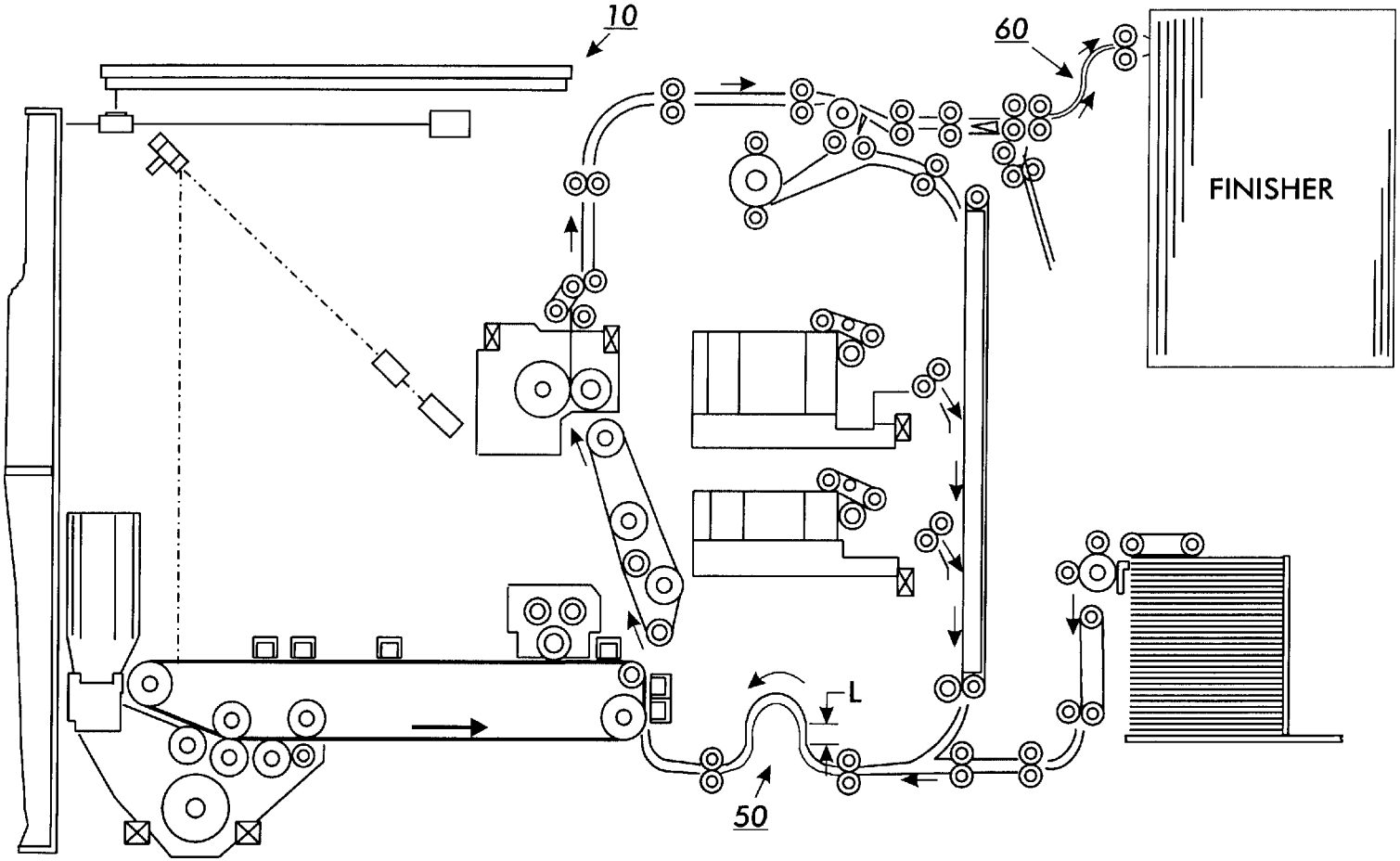
FIG. 3 is a plan view of an exemplary known xerographic printer, showing two different embodiments of the subject sheet side shifting system, one in the sheet registration paper path just before printing and another in the printer output to a finisher.

Describing now in further detail the exemplary embodiment with reference to the Figs, there is shown in FIG. 3 one example of a reproduction machine 10 merely by way of one example of applications of the subject sheet lateral shifting or registration system. However, for illustration clarity the sheet side shifting system example 20 of FIGS. 1 and 2 will be described first.

Figure 1:
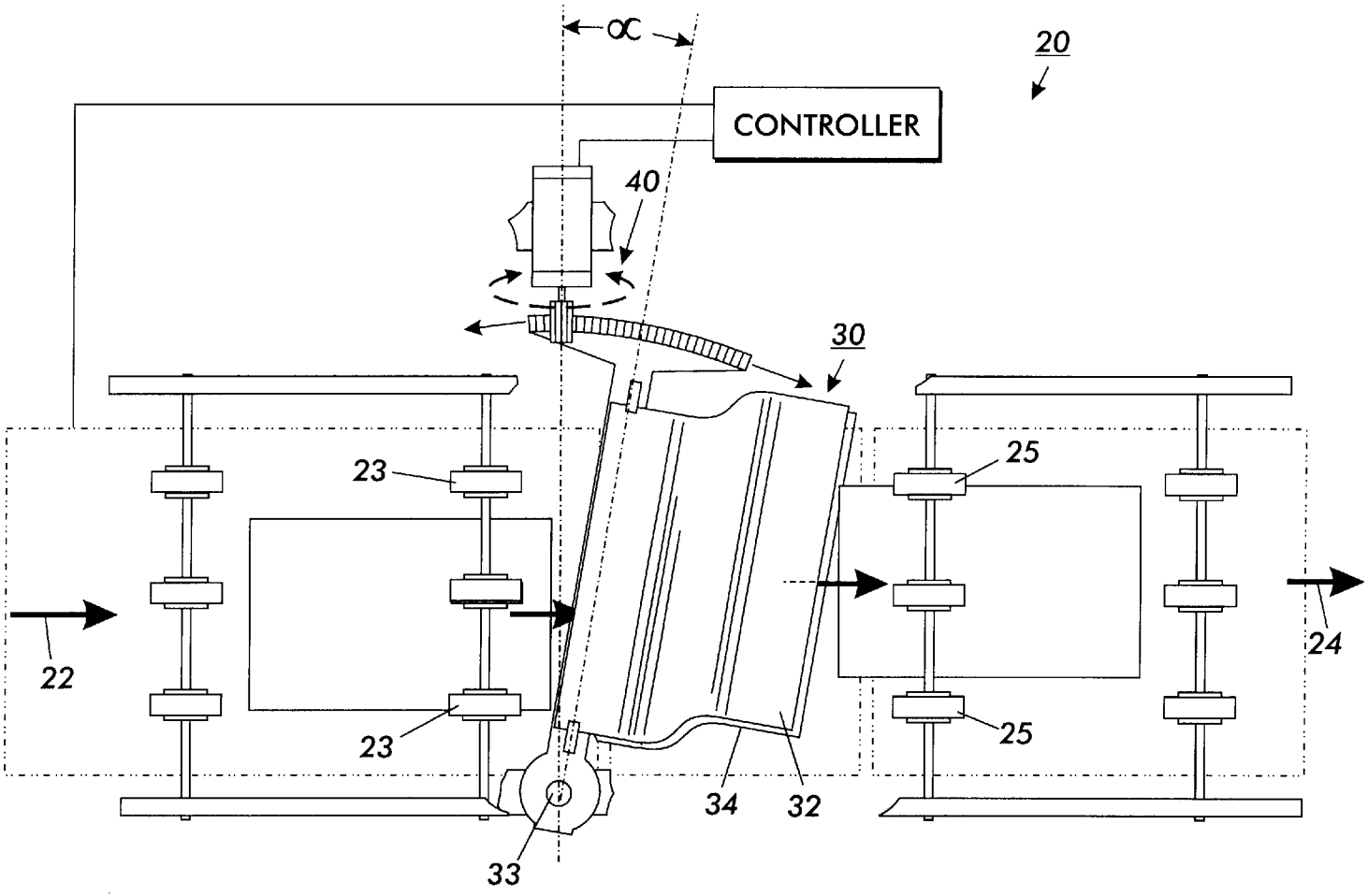
FIG. 1 is a schematic top view of one embodiment of the subject sheet side shifting system.

In this system 20, the sheet input path 22 and output path 24 may be conventional, co-linear, and of various known types, and need not be described in detail. In this example, as shown in FIG. 1, the sheet input to the system 20 is provided by conventionally driven and positioned rollers 23 across the sheet input path 22 with conventional mating idlers (not shown) and parallel sheet path defining baffles, defining a linear, non-skewed, sheet path directly into an "S" baffle system 30 defined by a pair of closely superposed "S" shaped sheet path defining baffles 32, 34. The arcuate sheet transport path they define has two large radius, oppositely curved, curves R' and R" (FIG. 2), which are too large (too smooth a curve) to present a potential sheet jam problem. E.g., at least several centimeters in radius. The two opposing curves R' and R" here smoothly transition into one another to form a continuous moving "S" shaped sheet path between the baffles 32, 34.

The sheet path length within this "S" baffle system 30 is preferably shorter than the smallest sheet dimension to be fed in the sheet path direction, e.g., less than about 20 cm for standard letter size sheets being fed widthwise (long edge first). That way each sheet being handled by the system 20 will be positively engaged with either the sheet input feed rollers 23, the sheet output feed rollers 25, or both. To express it another way, unlike most of the above-cited side shifting systems, here each sheet does not have to be released by both the upstream and downstream sheet feeding nips in order to be side shifted, and this enables a shorter sheet path side shifting system. The entire "S" path baffle system 30 can thus desirably take less than one sheet length in the overall sheet path length, and thus even reduce the existing sheet path length of reproduction apparatus and/or sheet path interconnections to finishers or other sheet handling modules. The arcuate, semi-folded, nature of the "S" path reduces its external process direction length even further. Thus, this entire system 20 can be easily inserted or incorporated as an interface or short transitional sheet transport path segment and/or modular unit into various sheet paths, wherever side shifting, with or without induced skew, especially, variable, controlled, side sifting without induced skew in the output, is desired.

In this example, it may be seen that the sheet side shifting system 20 is providing a sheet path connection or segment in which the baffle system 30 is transitioning the sheets smoothly between two planar, horizontal sheet paths 22 and 24. Here, it is also providing a vertical height step change "H" between the sheet input and output paths 22, 24.

As shown in FIG. 1, the sheets may all exit the baffle system 30 into output nips defined by conventional downstream feed rollers 25. Like the upstream rollers 23, the downstream rollers 25 can be conventionally mounted and continuously engaged and driven on fixed axes transverse the paper path. That is, none of the rollers 23 or 25 need be differently or specially driven, or laterally shifted, unlike various of the above-cited and other sheet lateral registration systems.

In this example, the system 20 can provide a desired amount of sheet side shift, yet without inducing any sheet skew, within the integral "S" baffles system 30, as will be described. The entire integral "S" baffle system 30 is pivotally mounted 33 at one side of the paper path to be pivoted at a selected angle to the paper path by a pivoting system 40. One-piece baffles 32, 34 are shown here, but it will be appreciated that conventional plural partial baffle sections can be conventionally interconnected to form the same or other desired sheet path. In this example, shown in FIGS. 1 and 2, the pivoting of the baffle unit may be simply accomplished by simple controlled rotation with a conventional programmable controller 100 (which may be that of the printer 10) of a motor M driving a rack 42 connected to rotate the baffle system 30 to a desired angle to the paper path sufficient to induce the desired amount of side shift in the sheets passing through the "S" baffle system 30. That is, side shifting of the sheets passing through the system 20 is accomplished simply by skewing the paired curved baffles relative to the process paper path direction. The more skew, the more the more the sheet is side shifted between its input and output from the baffle system 30.

Turning to FIG. 3, there is scematically shown two additional embodiments 50 and 60 of the sheet side shifting system 20 described above, in a xerographic printer reproduction apparatus 10. The side shifting system 50 is "U" shaped, an inverted "U" in this example. This may be considered as two back to back interconnected "S" paths, with twice the arcuate path length of one corrresponding "S" path, thus twice the amount of side shifting for the same skewing angle of this system 50, but with the entrance and exit paths in the same plane, with no vertical height difference as in the system 20 embodiment of FIGS. 1 and 2. The system 50 could likewise be used in various sheet path segments or interfaces, and is shown here providing lateral sheet registration, by a controlled variable side shift, of the sheets about to enter the transfer station for printing in the reproduction apparatus 10. The sheet side shifting system 60 is a version of the system 20 which is also providing the interconnect transport between the output of the reproduction apparatus 10 and the finisher 60. That is particularly desirable if, as described above, one is a sheet side registering machine and the other is a sheet center registering machine, so that the system 60 can provide the necessary side shift for the sheets, which of course varies with the size of the sheet, in a short transport path.

Further describing the embodiments and their theory of operation (and alternatives), first, the S-curve path of the "S" baffle system 30 can be considered as two one-quarter cylindrical baffles, oppositely oriented, and joined together. That is, it may be considered as a positive quarter cylinder followed by a negative quarter cylinder. Since the axis of the S-curve has an angle to the moving (process) direction of the paper, the entering paper sees an elliptical half-cylinder surface (baffle) waiting for it to enter obliquely. (A circular cylinder has an elliptical cross-section when cut obliquely.) The paper thus advances spirally along the elliptical half-cylinder like a screw thread.

As indicated, the paper travels obliquely as a spiral along an elliptical path over the surface of the first quarter-cylinder. Whatever amount of skew is made in the first half-cylinder is subtracted by an equal amount of de-skew made in the oppositely oriented second quarter-cylinder. Therefore, the skew is cancelled and only the side shift is added. So the paper leaves the S-curve system with a net side shift which is determined by the spiral nature of the travel, which is determined by the angle of the S-shaped path relative to the sheet path.

The lateral friction of the baffles is large enough to prevent any tendency of the sheet to slip laterally. (Any drive or hard roller nips placed inside the S-curve may complicate an analysis. If those nips take over the control of the paper, it may get hold of the paper at the wrong position and produce skew when the paper emerges from the end of the S-curve.) At the junction of the positive quarter cylinder and the negative quarter cylinder, the curvature of the two quarters may be different due to the wall distance of the baffle forming the paper path. The thickness of the baffle, the baffle friction, and the orthotropicity of the paper's stiffness will determine which surface of the baffle, the inner or outer surface, the paper is going to be in contact at any point.

As an alternative, or another embodiment, the two halves of the S-curve do not have to be exactly equal and oppositely oriented. Their diameters may be different, and the subtended angles need not to be 180 degrees. Also, the two halves can each be curves of less than 90 degrees. This means that the exit plane of the paper, the side shift, and the skew, may all be differently prescribed, although this complicates the analysis. One needs to optimally change the radii and the subtended angles of the two oppositely oriented cylindrical baffles. The equations for the analysis are more complex for such variations, and not important from a patentability viewpoint.

The simpler, nominal, case in this example is the one described, with the exit plane parallel to the input plane, and side shift only, with no desired induced (increased or decreased) skew in the output. The formula for the amount of side shift in the system 20 with a symmetrically hemicylindrical "S" path (where R'=R"), can be expressed as: SIDE SHIFT=$[(\pi-2)R+L]\sin\alpha$; where R is the radius of the two quarter-cylindrical baffle portions, L is the length of any straight portion between them, if any, and $\alpha$ is the angle of the baffles with respect to the paper path.

It may be seen that the amount of side shift can be changed by changing that angle, or by changing the spacing between the two baffle portions. Thus, an alternative side shift control system would be to keep the baffles at the same fixed angle to the paper path, but variably telescope the length "L" of a linear baffle segment interconnecting them.

Taking as a specific example the "U" path or "double" "S" baffle system 50 of FIG. 3, with four ninety degree sheet curves or turns, and assuming a baffle radii R of 40 mm and two interconnecting linear vertical paths lengths L of 50 mm each, the baffle unit skew angle $\alpha$ to achieve, e.g., a (very substantial) 44.5 mm sheet lateral offset therein would be 13.4 degrees derived from the above formula.

Note that the baffle unit angle $\alpha$ for the desired offset need only be set once and left in that position for each sheet until it is desired to change the amount of offset (unless each sheet is entering the system with sensed varying pre-existing offsets needing varying corrections). This is much simpler, easier, and less wear inducing than above-cited sheet offset systems that must make rapid changes and movements for each sheet. Also, less likely to have inadvertent slip from rapid accelerations or decelerations of the sheet, which are not needed here.

The entrance and exit nips, that is, the feed roller set at the upstream and downstream ends of the skewed arcuate or "S" baffles, will not affect or fight for control of the sheet. Neither the entrance or exit nips need to be opened or released during sheet transport (to release the sheet for lateral movement), unlike some other lateral registration systems. That is one of the significant advantages of this system—the sheet can be under the control of both the entrance and exit sheet transports (nips) at the same time, even though side shifting is taking place within the "S" baffle sheet path therebetween.

However, the "S" baffle entrance or exit nips could potentially oppose or fight with any (optional) nips that might placed intermediately of the "S" path. For this reason, it is preferred not to have such intermediate nips within the "S" path. Any such optional sheet handling nips that would be placed within the "S" baffle path should desirably be of a laterally compliant or non-positive type (e.g., deformable, laterally flexible, soft foam rollers acting against the opposing baffle). An alternative would be to have any such nips mounted within the "S" baffle automatically rotate (be axially skewed) to follow the direction of the sheet within the "S" baffle at the nip position. However, that would add some cost and complexity to what is an otherwise a very simple and low cost system.

With the disclosed system, the entrance and exit nips may maintain feeding and control of the sheet and prevent skew. When the sheet is entering and leaving the "S" baffles, it is travelling purely (linearly) in the process direction.

It will be noted that the terms "half-cylindrical" or "hemi-cylindrical" are used in the above specification in describing the overall sheet path arcuate length of the illustrated "S" baffle example. That is, in the illustrated "S" path example of two interconnecting 90 degree "C" sections, with the bottom of one "C" connecting to the top of the other "C" (and one "C" reversed relative to the other), and parallel sheet entrance and exit planes, as described, this particular "S" baffle example consists of two contiguous but oppositely curved "quarter-cylindrical" (90 degree) sections making a total "S" path arcuity one-half-cylinder. It will be appreciated however, as discussed, that the actual or exact arc length of the baffle curves will depend on the specific desired configuration and is not limited to the above example.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a lateral sheet shifting system for the image substrate sheets of a reproduction apparatus, with a sheet input and a sheet output, wherein said sheets are being fed in a process direction in a sheet feeding path from said sheet input to said sheet output with controlled shifting of said sheets transversely of said process direction, said lateral sheet shifting system comprising:

an arcuate sheet path defining baffle unit operatively interconnecting between said sheet input and said sheet output to define an arcuate sheet feeding path therein through said arcuate sheet path defining baffle unit;

said arcuate sheet path defining baffle unit being mounted for pivotal movement angularly of said process direction;

and a controllable variable angle pivoting system for pivoting said arcuate sheet path defining baffle unit angularly of said process direction;

said sheets being laterally shifted transversely of said process direction within said arcuate sheet path defining baffle unit in proportion to said controllable variable angle pivoting of said arcuate sheet path defining baffle unit by said controllable variable angle pivoting system;

wherein said arcuate sheet path defining baffle unit defines a generally "U" shaped sheet path formed by two opposingly oriented and consecutively operatively connected "S" shaped sheet paths having smoothly transitioned and large radius curved surfaces for unobstructed sheet movement therethrough.

2. The lateral sheet shifting system of claim 1, wherein said arcuate sheet path defining baffle unit comprises opposing relatively closely spaced similarly arcuate baffles.

3. The lateral sheet shifting system of claim 1, wherein said arcuate sheet path defining baffle unit consists solely of opposing arcuate baffles, and said sheets therein are not engaged by any sheet feeding rollers.

4. The lateral sheet shifting system of claim 1, wherein said arcuate sheet path defining baffle unit is pivoted at an angle laterally of said process direction to form a spiral sheet path therein.

5. The lateral sheet shifting system of claim 1, wherein said arcuate sheet path defining baffle unit is pivoted at an angle laterally of said process direction and induces lateral side shifting without any skew in said sheets passing therethrough.

6. The lateral sheet shifting system of claim 1, wherein said sheet input and said sheet output comprise fixed sheet feed rollers with a fixed axis of rotation perpendicular to said process direction.

7. The lateral sheet shifting system of claim 1, wherein said arcuate sheet path defining baffle unit has a sheet path entrance and a sheet path exit at opposite ends of said generally "U" shaped sheet path which linearly transition into said sheet feeding path of said reproduction apparatus in substantially the same plane.

8. The lateral sheet shifting system of claim 1, wherein said arcuate sheet path defining baffle unit comprises four sequentially operatively connecting generally quarter-cylindrical shaped baffle portions forming said sheet path therethrough.

* * * * *